US012788077B2

(12) United States Patent
Magnin

(10) Patent No.: US 12,788,077 B2
(45) Date of Patent: Nov. 10, 2026

(54) TWO-PERSON SPORTS GARMENT

(71) Applicant: Collin James Magnin, Oconto Falls, WI (US)

(72) Inventor: Collin James Magnin, Oconto Falls, WI (US)

( * ) Notice: Subject to any disclaimer, the term of this patent is extended or adjusted under 35 U.S.C. 154(b) by 0 days.

(21) Appl. No.: 19/195,997

(22) Filed: May 1, 2025

(65) Prior Publication Data

US 2025/0338903 A1 Nov. 6, 2025

Related U.S. Application Data

(60) Provisional application No. 63/642,832, filed on May 5, 2024.

(51) Int. Cl.
*A41D 1/04* (2006.01)
*A41D 27/08* (2006.01)

(52) U.S. Cl.
CPC ..... *A41D 1/04* (2013.01); *A41D 27/08* (2013.01); *A41D 2300/322* (2013.01); *A41D 2300/324* (2013.01)

(58) Field of Classification Search
CPC ..... A41D 1/04; A41D 27/08; A41D 15/00; A41D 1/215; A41D 13/1245
See application file for complete search history.

(56) References Cited

U.S. PATENT DOCUMENTS 487,000 A * 11/1892 Auer ..... A41D 1/04 2/119
1,282,581 A * 10/1918 House ..... A47G 9/066 2/69
2,636,176 A * 4/1953 Ross ..... A41D 3/02 2/93
2,911,650 A * 11/1959 Gerich ..... A41D 1/215 2/104
D196,096 S * 8/1963 Griffith et al. ..... 2/84
3,258,781 A * 7/1966 Klein ..... A41D 3/08 D2/866
3,523,302 A * 8/1970 Rabedeaux ..... A47G 9/066 5/413 R
3,837,006 A * 9/1974 Laseman ..... A41D 3/08 2/69.5
4,004,294 A * 1/1977 Pinch ..... A41D 1/215 2/104
4,089,067 A * 5/1978 Velasco ..... A41D 1/04 2/69

(Continued)

OTHER PUBLICATIONS

Google Search, Two-person Christmas-themed sweaters [online], [site visited: Jun. 6, 2025], <URL: https://www.google.com/search?q=Two-person+Christmas-themed+sweaters&sca_esv=7665cda6fcdc6470&ei=nD1DaM_GMMD-ptQPqM_puAg&ved%E2%80%A6> [10 pgs].

(Continued)

*Primary Examiner* — Heather Mangine
(74) *Attorney, Agent, or Firm* — QUARLES & BRADY LLP

(57) ABSTRACT

A two-person sports garment includes a first half and a second half removably attached to the first half. The first half and the second half are secured to each other in a front of the garment by a plurality of snap-on buttons, and the first half and the second half are secured to each other in a rear of the garment by a zipper. The two-person sports garment is configured to be worn by two people at the same time.

18 Claims, 9 Drawing Sheets

(56) References Cited

U.S. PATENT DOCUMENTS 4,535,479 A * 8/1985 Paula ..... A41D 1/04 2/69.5
D294,191 S * 2/1988 Paula ..... D2/831
4,773,102 A * 9/1988 Curtis ..... A41D 1/04 2/93
5,101,513 A * 4/1992 Bowers ..... A41D 3/08 2/87
5,201,075 A * 4/1993 Svetich ..... A41D 15/00 2/93
5,384,915 A * 1/1995 Rodriguez ..... A41D 1/02 2/93
5,544,365 A * 8/1996 Mondy ..... A41D 27/08 2/69
D381,788 S * 8/1997 Griggs ..... D2/717
5,657,489 A * 8/1997 Ponstein ..... A41D 3/08 2/88
D410,317 S * 6/1999 Alexander ..... D2/840
5,970,518 A * 10/1999 Jordan ..... A41D 1/00 2/69
6,175,966 B1 * 1/2001 Wiesenthal ..... A41D 27/08 2/244
6,550,066 B1 * 4/2003 Brassey ..... A41D 27/08 2/93
6,658,665 B2 * 12/2003 Dodge ..... A41D 13/01 2/87
6,782,554 B1 * 8/2004 Froehlich ..... A41D 27/08 2/244
8,001,618 B2 * 8/2011 Bay ..... A41D 27/28 2/96
D661,467 S * 6/2012 Whitefield ..... D2/840
D733,399 S * 7/2015 King ..... D2/804
D736,499 S * 8/2015 Byrd ..... D2/849
9,185,940 B2 * 11/2015 Sparks ..... A41D 15/04
9,609,898 B2 * 4/2017 Kanayama ..... A41D 31/102
D822,344 S * 7/2018 Karim ..... D2/728
D839,546 S * 2/2019 Noiberg ..... D2/826
D841,292 S * 2/2019 Vance ..... D2/840
10,413,000 B1 * 9/2019 Reeves ..... A41D 15/005
D876,753 S * 3/2020 Francis ..... D2/840
D880,816 S * 4/2020 Russo ..... D2/830
10,772,366 B1 * 9/2020 Ngan ..... A41D 15/04
D952,292 S * 5/2022 Blair ..... D2/828
2004/0158911 A1 * 8/2004 Amnuel ..... A41D 27/08 2/115
2004/0237167 A1 * 12/2004 Curry ..... A41D 3/08 2/88
2005/0081276 A1 * 4/2005 Reynolds ..... A41D 3/08 2/69
2007/0124845 A1 * 6/2007 McCoy ..... A41D 1/215 2/104
2007/0245450 A1 * 10/2007 Feodoroff ..... A41D 13/1254 2/114
2007/0250982 A1 * 11/2007 Norman ..... A41D 27/08 2/69
2008/0092265 A1 * 4/2008 Gage ..... A41D 27/10 2/69
2008/0178364 A1 * 7/2008 Brickle ..... A41D 15/00 2/69.5
2008/0196140 A1 * 8/2008 Mayerson ..... A41D 1/04 2/84
2008/0276345 A1 * 11/2008 Brown ..... A41D 1/04 2/93
2009/0007310 A1 * 1/2009 Armour ..... G09F 21/02 2/244
2009/0260132 A1 * 10/2009 Tomlinson ..... A41D 27/08 2/244
2009/0320175 A1 * 12/2009 Shih ..... A41D 15/00 2/243.1
2010/0115684 A1 * 5/2010 Freedman ..... A41D 27/201 2/243.1
2010/0146680 A1 * 6/2010 Cuoco ..... A41D 3/08 2/84
2010/0192276 A1 * 8/2010 Anderson ..... A41D 1/04 2/69
2014/0189929 A1 * 7/2014 Gooch ..... A41D 27/08 2/69
2015/0052657 A1 * 2/2015 Miller ..... A41D 13/0015 2/93
2015/0059048 A1 * 3/2015 Stanley ..... A41D 13/129 2/69
2016/0021950 A1 * 1/2016 Rafieiankopaei ..... A41D 15/00 2/243.1
2016/0073703 A1 * 3/2016 Shimada ..... A41D 1/215 2/104
2016/0073716 A1 * 3/2016 Short ..... A41D 1/02 2/247
2016/0088886 A1 * 3/2016 Kirwan ..... A41D 13/1245 2/114
2016/0174614 A1 * 6/2016 Kimmet ..... A41B 1/08 2/116
2016/0242473 A1 * 8/2016 Cameron ..... A41D 15/00
2016/0309812 A1 * 10/2016 Scheid ..... A41D 15/00
2017/0172230 A1 * 6/2017 Macfarlane ..... A41D 15/00
2017/0245558 A1 * 8/2017 Smith ..... A41D 13/0015
2018/0116302 A1 * 5/2018 Hines ..... A41D 1/215
2018/0255853 A1 * 9/2018 Spathas ..... B65D 33/00
2019/0008222 A1 * 1/2019 Afjeh ..... A41D 15/00
2019/0059462 A1 * 2/2019 Grogro ..... A41D 13/0007
2019/0125012 A1 * 5/2019 White, Jr. ..... A41D 15/00
2019/0134351 A1 * 5/2019 Poutre ..... A41D 27/10
2019/0183188 A1 * 6/2019 Mougey ..... A41D 1/215
2019/0200739 A1 * 7/2019 Green Mullins .. A41D 13/0012
2019/0364992 A1 * 12/2019 Thomas ..... A41D 13/1245
2020/0008500 A1 * 1/2020 Speciale ..... A41D 27/10
2020/0196691 A1 * 6/2020 Abukashef ..... A41D 1/04
2021/0052023 A1 * 2/2021 Antunes ..... A41D 31/305
2021/0204622 A1 * 7/2021 Ichigaya ..... A41D 3/04
2021/0204624 A1 * 7/2021 Robinson ..... A41D 25/003
2022/0264971 A1 * 8/2022 DeLara ..... A41D 13/1245
2022/0354224 A1 * 11/2022 Hopkins ..... A41D 3/005
2022/0378122 A1 * 12/2022 Crystal ..... A41D 1/21
2023/0029804 A1 * 2/2023 Paulasir ..... A41D 13/1245
2023/0255282 A1 * 8/2023 Gitlin ..... A41D 27/08 2/70
2024/0122784 A1 * 4/2024 Roberts ..... A41D 1/04
2024/0251890 A1 * 8/2024 Andrews ..... A41D 13/1245
2024/0260685 A1 * 8/2024 Robell ..... A41D 13/0015
2025/0204622 A1 * 6/2025 Drezek ..... A41D 13/129
2025/0302128 A1 * 10/2025 Phillips ..... A41D 3/005
2025/0338903 A1 * 11/2025 Magnin ..... A41D 27/08

OTHER PUBLICATIONS

Snuggie® - The Official Blanket with Sleeves—Snuggie Store [online], [site visited Jun. 6, 2025], <URL: https:// snuggiestore.com/?gad_source=1&gad_campaignid=21880379928&gclid=EAlalQobChMlxljDr8LdjQMVtDUIBR2wHDdgEAAYASAAEgljdPD_B%E2%80%A6> [6 pgs.].

Amazon, Snuggie, Amazon.com [online], [site visited: Jun. 6, 2025], <URL: https://www.amazon.com/stores/Snuggie/page/2ACEDB18-F9AB-47E8-A954-474F4522CDA2?is_byline_deeplink=true&deeplink=DE11AF8D-ECC9-4%E2%80%A6> [5 pgs.].

Etsy, Personalised Double Jumper Custom Printed Twosie Sweater Personal Couple Two Person Sweatshirt Funny Partner Wedding Birthday Top Your Text, Etsy.com [online], [site visited Jul. 18, 2025], <URL: https://www.etsy.com/listing/582126710/personalised-double-jumper-custom> [19 pgs.].

* cited by examiner

TWO-PERSON SPORTS GARMENT

CROSS REFERENCE TO RELATED APPLICATIONS

This application claims the benefit of and priority to U.S. Provisional Patent Application No. 63/642,832, filed on May 5, 2024, and entitled "Two Person Sports Garment," which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates generally to clothing, and more particularly, to an article of apparel or garment that can be worn by two people at the same time.

2. Description of the Background

Conventional sports garments or jerseys allow for fans to support and represent a specific sport or team. Conventional sports garments or jerseys are worn at sporting events or casually and are designed for a single person to wear. Further, sports team logos have also been provided on reversible clothing articles to permit the wearer to choose either of two team logos to be displayed. However, these prior art garments are generally limited to a wearer picking one of the logos to represent at a time and are limited to being worn by a single person at one time.

Therefore, a sports garment or jersey that can be worn by two people at once is desired. Further, a sports garment or jersey that can be split between two different teams is desired. These and other deficiencies with the prior art are outlined in the following disclosure.

SUMMARY

A number of advantages of an article of apparel or garment described herein will be apparent to those having ordinary skill in the art. For example, the garment can allow two people to wear a single garment at the same time. Further, the garment can allow two fans of different teams to support two different teams at once. Furthermore, the garment can allow two sports fans to wear the same, single jersey in a side-by-side fashion. Still further, the garment can allow shared warmth in cold environments. Still further, the garment can offer a comedic visual.

In one aspect of the present disclosure, a two-person sports garment includes a first half and a second half removably attached to the first half. The first half and the second half are secured to each other in a front of the garment by a plurality of snap-on buttons, and the first half and the second half are secured to each other in a rear of the garment by a zipper. The two-person sports garment is configured to be worn by two people at the same time.

In some embodiments, the first half includes a first arm sleeve that forms a first armhole and the second half includes a second arm sleeve that forms a second armhole. In some embodiments, the first half includes a first arm slit and the second half includes a second arm slit. In some embodiments, the first arm slit and the second arm slit are positioned closer to the plurality of snap on buttons than the first armhole and the second armhole, respectively. In some embodiments, the two-person sports garment is configured to have a first arm of a first person extend through the first armhole and a second arm of the first person extend through the first arm slit. The two-person sports garment is further configured to have a first arm of a second person extend through the second armhole and a second arm of the second person extend through the second arm slit. In some embodiments, the two-person sports garment includes a removable inner liner. In some embodiments, the first half and the second half each includes a plurality of text thereon. In some embodiments, the first half represents a first sports team and the second half represents a second sports team different than the first sports team. In some embodiments, the two-person sports garment includes a plurality of lower straps that are configured to hold up a bottom end of the two-person sports garment.

In another aspect of the present disclosure, a sports garment includes a first half and a second half removably attached to the first half. The sports garment also includes a garment neck opening formed by the first half and the second half. The garment neck opening defines a width of between about 20 inches and about 30 inches when lying flat on a surface. The garment defines a height from a bottom end of the sports garment to a topmost portion of the sports garment of between about 50 inches and about 70 inches when lying flat on a surface. The sports garment is configured to be worn by two people at the same time.

In some embodiments, the width is between about 22 inches and about 26 inches when lying flat on a surface. In some embodiments, the height is between about 58 inches and about 62 inches when lying flat on a surface. In some embodiments, the sports garment further includes a plurality of shoulder straps positioned within an interior cavity of the sports garment. In some embodiments, the first half includes a first zipper assembly and a plurality of first buttons, and the second half includes a second zipper assembly and a plurality of second buttons. In some embodiments, the first zipper assembly is configured to be secured with the second zipper assembly by a zipper, and the plurality of first buttons is configured to be secured with the plurality of second buttons. In some embodiments, the plurality of first buttons and the plurality of second buttons are snap on buttons that mate with each other. In some embodiments, the sports garment includes a name plate that is positioned partially on the first half and partially on the second half of the sports garment. In some embodiments, the first half represents a first sports team and the second half represents a second sports team different than the first sports team.

In yet another aspect of the present disclosure, a garment includes a first half that includes a first arm sleeve that forms a first armhole. The first half includes a first arm slit spaced from the first armhole. The garment also includes a second half that includes a second arm sleeve that forms a second armhole. The second half is removably attached to the first half, and the second half includes a second arm slit spaced from the second armhole. The garment is configured to be worn by a first person and a second person at the same time. The garment is configured for the first person to put their first hand through the first armhole and their second hand through the first arm slit. The garment is further configured for the second person to put their first hand through the second arm slit and their second hand through the second armhole.

In some embodiments, the first half of the garment is a different color than the second half of the garment.

Other aspects of the articles of apparel described herein, including features and advantages thereof, will become apparent to one of ordinary skill in the art upon examination of the figures and detailed description herein. Therefore, all such aspects of the articles of apparel are intended to be included in the detailed description and this summary.

DETAILED DESCRIPTION OF THE DRAWINGS

The following discussion and accompanying figures disclose various embodiments or configurations of a garment or article of apparel and a method for using the garment or the article of apparel. Although embodiments are disclosed with reference to a garment, such as a sports jersey, concepts associated with embodiments of the garment may be applied to a wide range of apparel, including t-shirts, long sleeve shirts, sweaters, pullovers, ponchos, and coats, for example.

The term "about," as used herein, refers to variations in the numerical quantity that may occur, for example, through typical measuring and manufacturing procedures used for articles of apparel or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes. As noted herein, all ranges disclosed herein are inclusive of the outer bounds of the range.

The present disclosure is directed to an article of apparel, such as a garment for an upper body and/or lower body of a wearer. The article of apparel may comprise a knitted component, a woven textile, a non-woven textile, leather, mesh, suede, polyester, nylon, elastane, spandex, synthetic fibers, or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, or other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, or double cloth weaves, for example. Non-woven textiles include textiles made by air-laid or spun-laid methods, for example. The garment may comprise a variety of materials, such as a first yarn, a second yarn, or a third yarn, which may have varying properties or varying visual characteristics.

Figure 1:
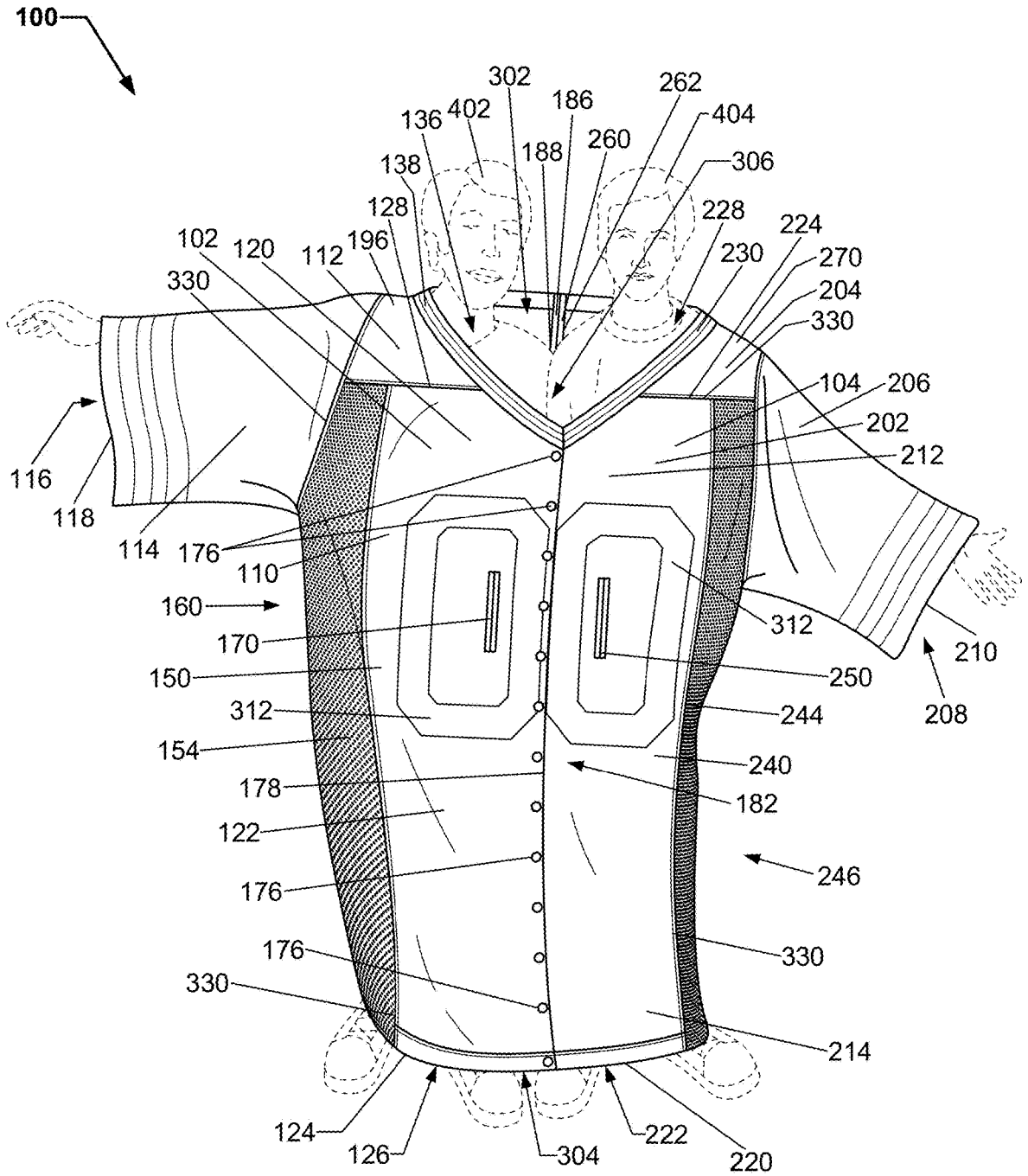
FIG. 1 is a front perspective view of an article of apparel configured as a garment, according to an embodiment of the present disclosure.

FIGS. 1-4 depict an exemplary embodiment of an article of apparel configured as a garment or sports garment 100. As illustrated in FIG. 1, a front perspective view of the garment 100 is shown. The garment 100 includes a first portion or half 102 and a second portion or half 104 removably secured with each other. The first half 102 of the garment 100 is a separate piece from the second half 104 of the garment 100. As will be described in further details herein, the first half 102 and the second half 104 of the garment 100 can be detached from each other to form two separate pieces (see FIG. 5A). The first half 102 is positioned on a right side of wearers of the garment 100 and the second half 104 is positioned on a left side of the wearers of the garment 100. As illustrated in FIG. 1, the garment 100 is configured to be worn by two people at the same time. Thus, the garment 100 is a single article of apparel that can be worn by two separate people at the exact same time.

As noted herein, the terms first half 102 and second half 104 relate to elements of the garment 100 and are not defined to mean that the first half 102 is exactly half of the garment 100 and that the second half 104 is exactly half of the garment 100. The first half 102 just relates to the right side (wearer's perspective) portion of the garment 100 and the second half 104 just relates to the left side (wearer's perspective) portion of the garment 100. As further noted herein, the term "first portion" can be used for the first half 102 and the term "second portion" can be used for the second half 104. Unless otherwise noted herein, the first half 102 and the second half 104 each relate to a portion of the garment 100 that includes at least about 40% of the total weight of or the total fabric used for the garment 100 in a use or end use state. However, in some embodiments, the first half 102 and the second half 104 may each relate to a portion of the garment 100 that includes at least about 41%, or at least about 42%, or at least about 43%, or at least about 44%, or at least about 45%, or at least about 46%, or at least about 47%, or at least about 48%, or at least about 49%, or at least about 50% of the total weight of or the total fabric used for the garment 100 in a use or end use state.

Figure 2:
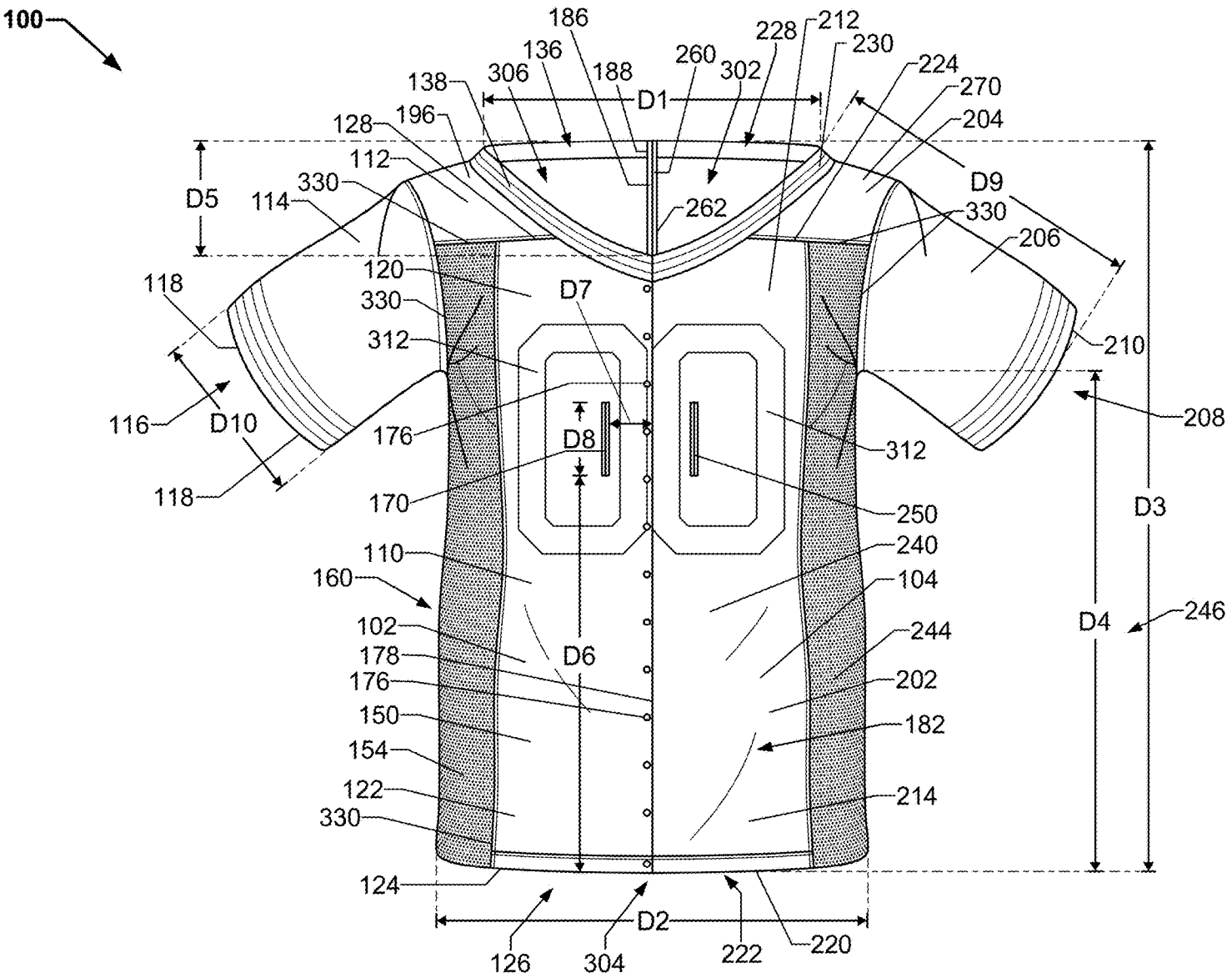
FIG. 2 is a front view of the garment of FIG. 1.
Figure 3:
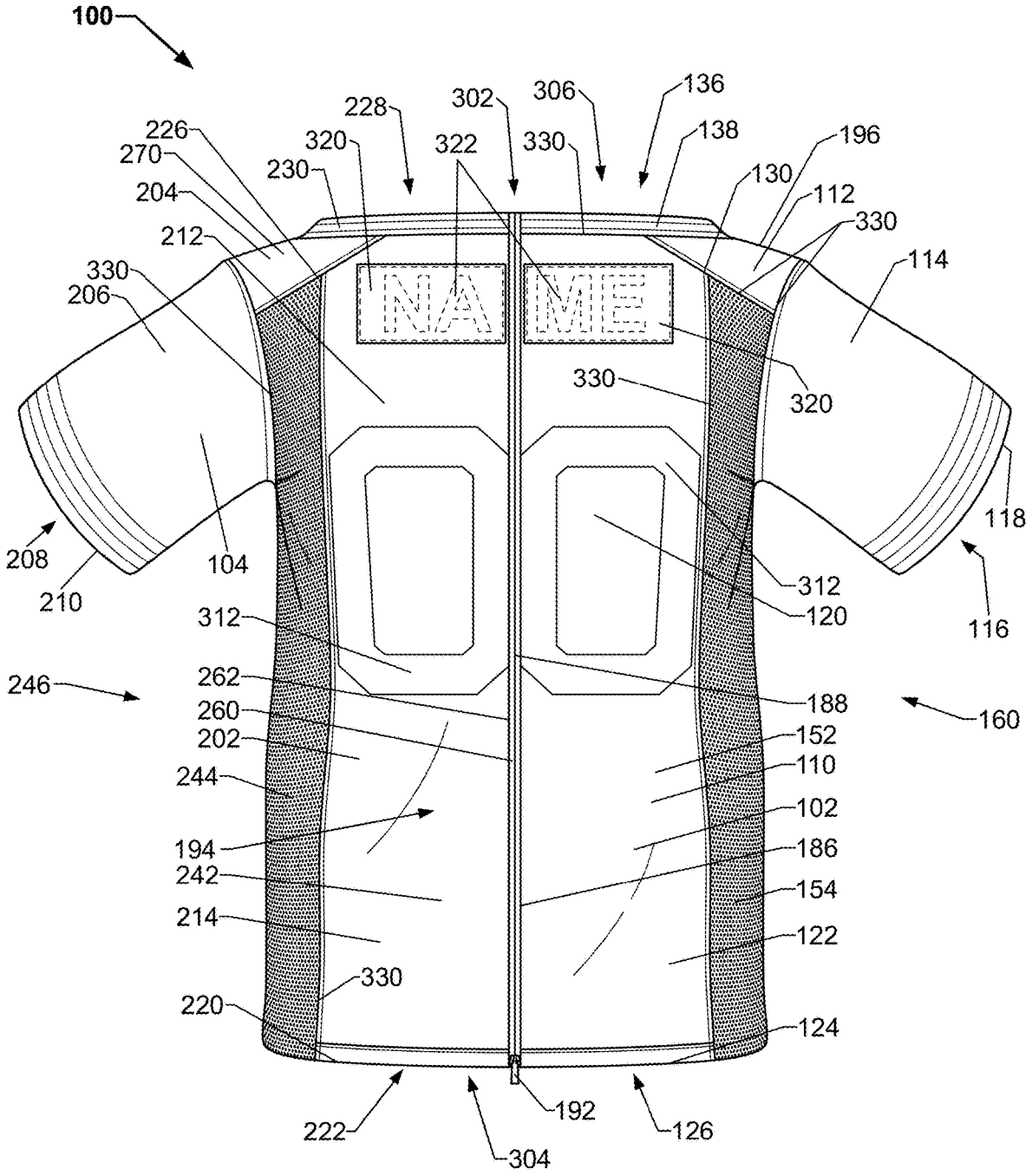
FIG. 3 is a rear view of the garment of FIG. 1.

Referring to FIGS. 1-3, the first portion or half 102 of the garment 100 includes a first body portion 110 and a first upper chest or yoke portion 112 defining a portion of a right or first arm sleeve 114. The first arm sleeve 114 extends from the first yoke portion 112 and the first body portion 110 and forms a first armhole 116 at a first distal end 118 of the first arm sleeve 114. The first body portion 110 comprises a first upper body portion 120 and a first lower body portion 122, and the first body portion 110 extends from a first bottom hem or end 124 that defines a first lower opening 126 to a first front bottom edge 128 and a first rear bottom edge 130 of the first yoke portion 112. As illustrated in FIG. 1, the first yoke portion 112 and the first body portion 110 define a first neck opening 136 that is bordered by a first collar or hem 138.

Referring still to FIGS. 1-3, the first body portion 110 of the first half 102 of the garment 100 includes a first front body portion 150, a first rear body portion 152, and a first mesh portion 154 positioned between the first front body portion 150 and the first rear body portion 152. The first mesh portion 154 is positioned on a right side 160 of the first half 102 of the garment 100 and allows for better ventilation into the first half 102 of the garment 100. In some embodiments, the first half 102 may not include the first mesh portion 154. Thus, in some embodiments, the first mesh portion 154 may not be made of a mesh material and instead be made of a material similar to the first front body portion 150 and/or the first rear body portion 152.

Referring to FIGS. 1 and 2, the first body portion 110 of the first half 102 of the garment 100 includes a first arm slit 170. The first arm slit 170 is positioned generally in the first upper body portion 120 of the first body portion 110 and on the first front body portion 150 of the first half 102. The first arm slit 170 is configured for one of the wearers to stick their arm through during use. In other words, the first arm slit 170 is an aperture or opening into the first half 102 for one of the wearers to be able to stick one of their arms therethrough. It is contemplated that the first arm slit 170 can be positioned on any portion of the first body portion 110 to assist wearers and allow wearers to stick their arm (arm closest to the other person) through the first arm slit 170.

Figure 5A:
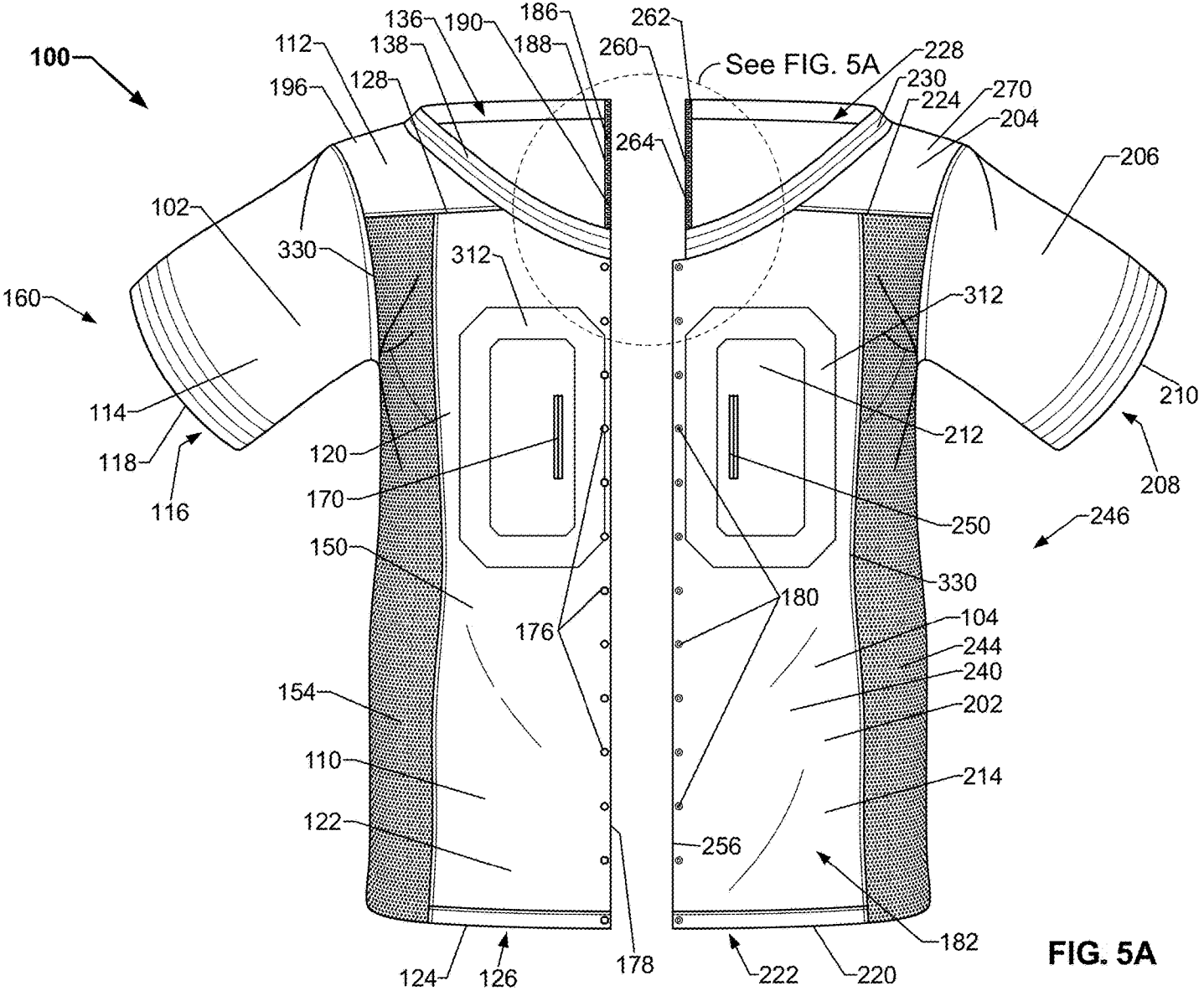
FIG. 5A is a front view of the garment of FIG. 1 separated into two portions or halves.
Figure 5B:
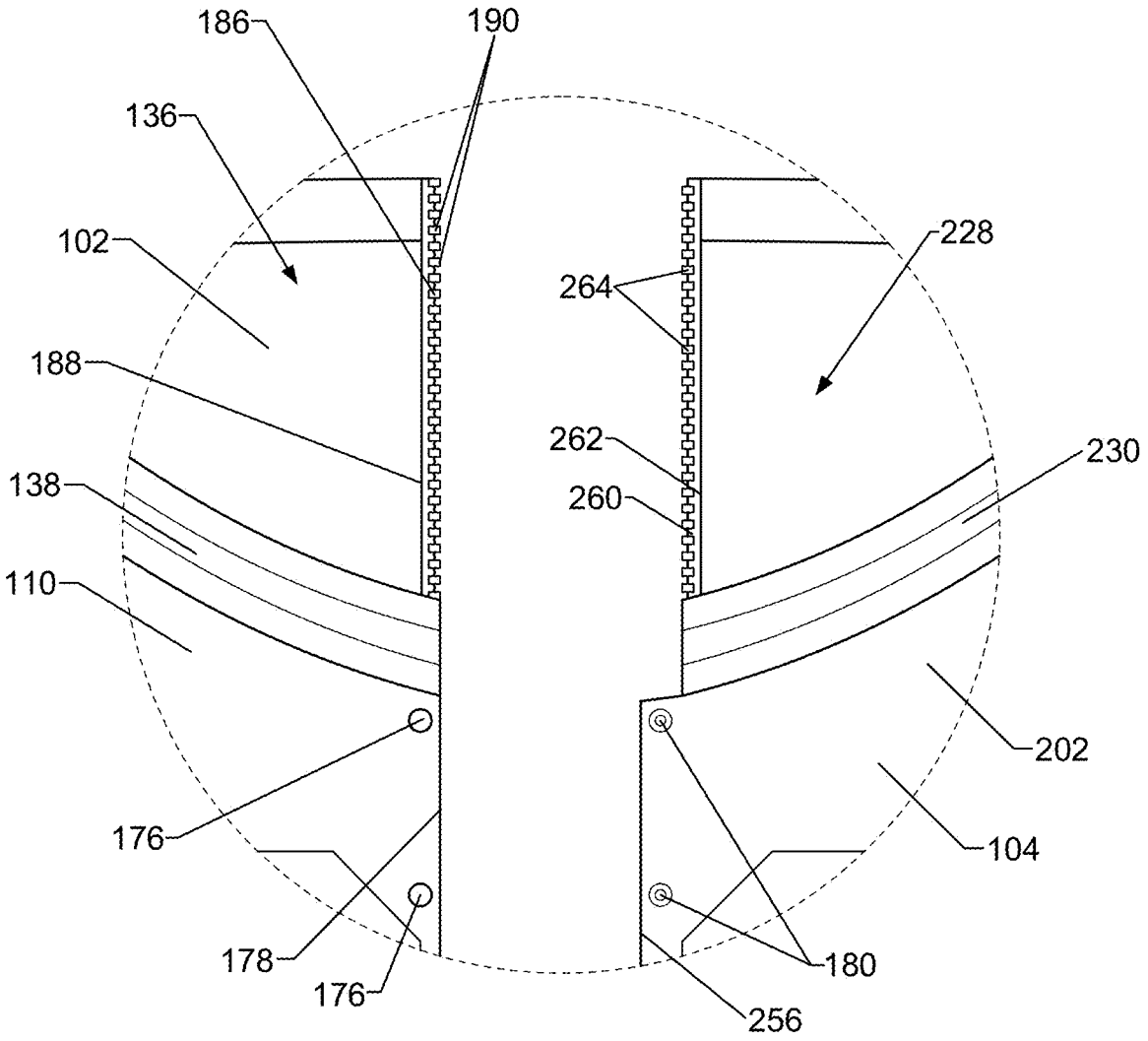
FIG. 5B is a detail view of the garment of FIG. 5A.

Referring to FIGS. 5A and 5B, the first body portion 110 of the first half 102 includes a plurality of first buttons 176 positioned adjacent a first front edge 178 of the first body portion 110. The plurality of first buttons 176 extend along the entire first front edge 178 and are configured to secure with a plurality of second buttons 180 positioned on the second half 104 of the garment 100. In other words, the plurality of first buttons 176 and the plurality of second buttons 180 are snap on buttons or button-snaps that are configured to mate and secure with each other to close a front 182 (see FIG. 2) of the garment 100. As illustrated in FIGS. 3, 5, and 5B, the first body portion 110 of the first half 102 includes a first zipper assembly 186 positioned on a first rear edge 188 of the first body portion 110. The first zipper assembly 186 includes a plurality of first teeth 190 (see FIG. 5B) positioned on the first rear edge 188 of the first body portion 110 that engage with a zipper 192. Thus, during use, the first half 102 and the second half 104 of the garment 100 are secured to each other by the zipper 192 to close a rear 194 (see FIG. 3) of the garment 100.

Referring still to FIGS. 1-3, the first yoke portion 112 of the garment 100 extends upwards from the first front bottom edge 128 at the front 182 of the garment 100. The first yoke portion 112 then extends over a first shoulder portion 196 of the garment 100 and back down the rear 194 of the garment 100 until reaching the first rear bottom edge 130. In some embodiments, the first yoke portion 112 may be larger or smaller than illustrated.

Referring still to FIGS. 1-3, the second half 104 of the garment 100 includes a second body portion 202 and a second upper chest or yoke portion 204 defining a portion of a left or second arm sleeve 206. The second arm sleeve 206 extends from the second yoke portion 204 and the second body portion 202 and forms a second armhole 208 at a second distal end 210 of the second arm sleeve 206. The second body portion 202 comprises a second upper body portion 212 and a second lower body portion 214, and the second body portion 202 extends from a second bottom hem or end 220 that defines a second lower opening 222 to a second front bottom edge 224 and a second rear bottom edge 226 of the second yoke portion 204. As illustrated in FIG. 1, the second yoke portion 204 and the second body portion 202 define a second neck opening 228 that is bordered by a second collar or hem 230.

Referring still to FIGS. 1-3, the second body portion 202 of the second half 104 of the garment 100 includes a second front body portion 240, a second rear body portion 242, and a second mesh portion 244 positioned between the second front body portion 240 and the second rear body portion 242. The second mesh portion 244 is positioned on a left side 246 of the second half 104 of the garment 100 and allows for improved ventilation into the second half 104 of the garment 100. In some embodiments, the second half 104 may not include the second mesh portion 244 (see FIG. 8). Thus, in some embodiments, the second mesh portion 244 may not be made of a mesh material and instead be made of a material similar to the second front body portion 240 and/or the second rear body portion 242.

Referring to FIGS. 1 and 2, the second body portion 202 of the second half 104 of the garment 100 includes a second arm slit 250. The second arm slit 250 is positioned generally in the second upper body portion 212 of the second body portion 202 and on the second front body portion 240 of the second half 104. Similar to the first arm slit 170, the second arm slit 250 is configured for one of the wearers to stick their arm through during use. In other words, the second arm slit 250 is an aperture or opening into the second half 104 for one of the wearers to be able to stick their arm therethrough. It is contemplated that the second arm slit 250 can be positioned on any portion of the second body portion 202 to assist wearers and allow wearers to stick their arm (arm closest to the other person) through the second arm slit 250.

Referring to FIGS. 5A and 5B and as discussed above, the second body portion 202 of the second half 104 includes the plurality of second buttons 180 positioned adjacent a second front edge 256 of the second body portion 202. The plurality of second buttons 180 extend along the entire second front edge 256 and are configured to secure with the plurality of first buttons 176 positioned on the first half 102 of the garment 100. As illustrated in FIGS. 3, 5A, and 5B and as discussed above, the second body portion 202 of the second half 104 includes a second zipper assembly 260 positioned on a second rear edge 262 of the second body portion 202. The second zipper assembly 260 includes a plurality of second teeth 264 positioned on the second rear edge 262 that engage with the zipper 192.

Referring again to FIGS. 1-3, the second yoke portion 204 of the garment 100 extends upward from the second front bottom edge 224 at the front 182 of the garment 100. The second yoke portion 204 then extends over a second shoulder portion 270 of the garment 100 and back down the rear 194 of the garment 100 until reaching the second rear bottom edge 226. In some embodiments, the second yoke portion 204 may be larger or smaller than illustrated.

As noted herein, the first half 102 of the garment 100 is very similar to the second half 104 of the garment 100. In some embodiments, the first half 102 of the garment 100 is a mirror image of the second half 104 of the garment 100 except for the plurality of first and second buttons 176, 180, the first and second zipper assemblies 186, 260, the zipper 192, and/or any text or iconography on the first half 102 and the second half 104. In other words, the first half 102 and the second half 104 consist of a substantial number of similar features. As discussed above, the first half 102 and the second half 104 of the garment 100 are configured to secure to each other to form the garment 100. In particular, the plurality of first buttons 176 on the first half 102 are configured to secure with the plurality of second buttons 180 on the second half 104 to form and secure the front 182 of the garment 100. Further, the first zipper assembly 186 is configured to mate with the second zipper assembly 260 by way of the zipper 192 to form and secure the rear 194 of the garment 100. Thus, the zipper 192 is positioned on the rear 194 of the garment 100 and the plurality of first and second buttons 176, 180 are positioned on the front 182 of the garment 100. As further noted herein, when the first half 102 and the second half 104 are secured together, e.g., as shown in FIGS. 1-4, the garment 100 is in an assembled state. When the first half 102 and the second half 104 are not secured together, e.g., as shown in FIGS. 5A and 5B, the garment 100 is in an unassembled state.

Once the garment 100 is in the assembled state, the first neck opening 136 and the second neck opening 228 form a garment neck opening 302. As will be discussed in further details herein, the garment neck opening 302 is much larger than typical neck openings on articles of apparel since the garment neck opening 302 is configured to fit two wearer's heads therethrough (see FIG. 1). Further, once the garment 100 is in the assembled state, the first bottom end 124 and the second bottom end 220 define a garment lower opening 304. During use, the wearers feet will extend through the garment lower opening 304 (see FIG. 1). As illustrated in FIG. 1, the garment 100 extends all the way down to the wearer's feet. In some embodiments, the garment 100 may stop near the wearer's waist, similar to a conventional shirt or jersey. Furthermore, once the garment 100 is in the assembled state, the garment forms an internal cavity 306. During use, the wearers are positioned within the internal cavity 306 of the garment 100 (see FIG. 1).

As noted herein, the zipper 192 and the first and second zipper assemblies 186, 260 are configured such that the zipper 192 opens from the bottom instead of from the top like conventional articles of apparel. Thus, once the rear 194 of the garment 100 is closed by the zipper 192 and the zipper assemblies 186, 260, the wearers of the garment 100 would zip the zipper 192 up from an area adjacent the garment lower opening 304 to unzip the garment 100. In other words, the zipper 192 is upside down. This configuration of the zipper 192 allows for a portion of the rear 194 of the garment 100 to be unzipped for a time. Specifically, the rear lower portion of the garment 100 can be unzipped in case the wearers are sitting down and there is something between the wearers, e.g., an armrest. Thus, the zipper assemblies 186, 260 can be slightly unzipped to allow the garment 100 to go over an armrest, for example, and to allow the wearers to sit together with minimal disruptions. As noted herein, in some embodiments, the zipper 192 may be able to be separated from the first or the second zipper assemblies 186, 260. Furthermore, in some embodiments, the zipper 192 may open up from the top instead of the bottom.

Referring again to FIGS. 1-4, the garment 100 includes a plurality of numbers 312 positioned on the front 182 and the rear 194 of the first and second halves 102, 104. Each half 102, 104 of the garment 100 includes the number 312 on the front 182 and the rear 194. The figures illustrate the garment 100 with "00"; however, it is contemplated that any number or combination of numbers can be put on the garment 100. Further, in some embodiments, the garment 100 may include different colors, textures, or fabrics. Furthermore, in some embodiments, the garment 100 may include one or more logos, graphics, iconography, texts, and/or designs positioned throughout the garment 100. As such, it is contemplated that the garment 100 may comprise any number or type of iconography and/or text thereon.

As illustrated in FIG. 3, the rear 194 of the garment 100 can include a name plate 320 that is positioned on both the first half 102 and the second half 104. The name plate 320 can be split in half by the first and second zipper assemblies 186, 260. The name plate 320 can include text 322 thereon. In some embodiments, the text 322 can be a player's name, the product's name, a company name, or the wearers name (s). In some embodiments, the rear 194 of the garment 100 may not include the name plate 320 and the text 322. In some embodiments, the garment 100 may include a hook and loop fastener, such as VELCRO®, or another securing means that allows for the name plate 320 to removably attach to the garment 100. Thus, in some embodiments, users or wearers of the garment 100 can switch out the name plate 320 with a different name plate 320.

As noted herein, the garment 100 is configured as a sports jersey and, in particular, an American football sports jersey. However, it is contemplated that the garment 100 can by any type of sports jersey for fans to root on their favorite professional, semi-pro, local, intermural, and/or collegiate teams. For example, the garment 100 can be a baseball jersey, a soccer jersey, a basketball jersey, a softball jersey, a rugby jersey, a cricket jersey, a polo jersey, a hockey jersey, and/or a volleyball jersey. Thus, the garment 100 offers fans a fun way to root for their favorite teams.

In some embodiments, the first body portion 110 and/or the second body portion 202 of the garment 100 may include a pocket or pouch to help store items therein. In some embodiments, the pocket or pouch may be positioned below the first and second arm slits 170, 250. Further, in some embodiments, the pocket or pouch may include a zipper to securely store items therein. Furthermore, in some embodiments, the garment 100 may include a storage area with a zipper near the first and second upper body portions 120, 212 above the first and second arm slits 170, 250. In some embodiments, each of the halves 102, 104 of the garment 100 may include a hood portion that form together to create a hood for the garment 100. Furthermore, in some embodiments, the first half 102 and the second half 104 of the garment 100 may include one or more pockets on the sides of the garment 100. For example, the pockets may be positioned where a traditional pant pocket would be located on each side of the garment 100. Still further, in some embodiments, the first half 102 and the second half 104 may include an interior storage portion or pocket for the wearers to access inside of the garment 100. As illustrated in FIGS. 1-4, the garment 100 can include a plurality of stitching lines 330 extending along the first half 102 and the second half 104.

Referring specifically to FIG. 2, when in the assembled state, the garment neck opening 302 has a width that defines a dimension D1. In some embodiments, the dimension D1 of the garment neck opening 302 may be between about 10 inches and about 50 inches, or about 15 inches and about 40 inches, or about 20 inches and about 30 inches, or about 22 inches and about 26 inches, or about 23 inches and about 25 inches, or about 24 inches, or at least about 15 inches, or at least about 20 inches, or at least about 22 inches, or at least about 23 inches, or at least about 24 inches. Further, the garment lower opening 304 has a width that defines a dimension D2. In some embodiments, the dimension D2 of the garment lower opening 304 may be between about 10 inches and about 90 inches, or about 20 inches and about 70 inches, or about 30 inches and about 60 inches, or about 40 inches and about 50 inches, or about 42 inches and about 46 inches, or about 44 inches, or at least about 20 inches, or at least about 30 inches, or at least about 40 inches, or at least about 44 inches. A ratio between the widths of the garment neck opening 302 and the garment lower opening 304 (D1/D2) may be between about 0.3 and about 1, or about 0.4 and about 0.8, or about 0.5 and about 0.6, or about 0.5, or about 0.55, or about 0.6, or at least about 0.3, or at least about 0.4, or at least about 0.5.

Referring still to FIG. 2, the first body portion 110 and the second body portion 202 of the garment 100 have a height that defines a dimension D3 from the first and second bottom ends 124, 220 to the uppermost portion of first and second yoke portions 112, 204, respectively. In some embodiments, the dimension D3 of the garment 100 may be between about 30 inches and about 90 inches, or about 40 inches and about 80 inches, or about 50 inches and about 70 inches, or about 58 inches and about 62 inches, or about 60 inches and about 61 inches, or about 60.5 inches, or at least about 30 inches, or at least about 40 inches, or at least about 50 inches, or at least about 60 inches. The first body portion 110 and the second body portion 202 of the garment 100 also have a dimension D4 from the first and second bottom ends 124, 220 to a bottom section of the first and second arm sleeves 114, 206, respectively. In some embodiments, the dimension D4 may be between about 20 inches and about 60 inches, or about 30 inches and about 50 inches, or about 35 inches and about 45 inches, or about 38 inches and about 43 inches, or about 41 inches, or at least about 30 inches, or at least about 40 inches, or at least about 41 inches.

Referring still to FIG. 2, the garment neck opening 302 has a height that defines a dimension D5. In some embodiments, the dimension D5 may be between about 2 inches and about 30 inches, or about 5 inches and about 15 inches, or about 8 inches and about 10 inches, or about 9 inches, or at least about 5 inches, or at least about 9 inches. The first body portion 110 and the second body portion 202 of the garment 100 also have a dimension D6 from the first and second bottom ends 124, 220 to a bottommost part of the first and second arm slits 170, 250, respectively. In some embodiments, the dimension D6 may be between about 10 inches and about 60 inches, or about 20 inches and about 50 inches, or about 30 inches and about 40 inches, or about 30 inches and about 35 inches, or about 33 inches, or at least about 20 inches, or at least about 30 inches, or at least about 33 inches.

The first body portion 110 and the second body portion 202 of the garment 100 also have a dimension D7 from the first front edge 178 and the second front edge 256 to the first arm slit 170 and the second arm slit 250, respectively. In some embodiments, the dimension D7 may be between about 1 inch and about 20 inches, or about 2 inches and about 10 inches, or about 3 inches and about 7 inches, or about 4 inches and about 5 inches, or about 4.75 inches, or at least about 2 inches, or at least about 4 inches, or at least about 5 inches. Furthermore, the first arm slit 170 and the second arm slit 250 each have a height that defines a dimension D8. In some embodiments, the dimension D8 may be between about 1 inch and about 20 inches, or about 2 inches and about 10 inches, or about 4 inches and about 8 inches, or about 6 inches and about 7 inches, or about 6 inches, or about 7 inches, or about 6.75 inches, or at least about 3 inches, or at least about 4 inches, or at least about 6 inches, or at least about 7 inches.

Referring still to FIG. 2, the first and second arm sleeves 114, 206 may have a dimension D9 from the garment neck opening 302 to the first and second distal ends 118, 210 respectively. In some embodiments, the dimension D9 may be between about 10 inches and about 40 inches, or about 20 inches and about 35 inches, or about 25 inches and about 32 inches, or about 29 inches and about 30 inches, or about 29.5 inches, or at least about 20 inches, or at least about 25 inches, or at least about 29 inches, or at least about 30 inches. The first and second armholes 116, 208 may have a dimension D10, respectively. In some embodiments, the dimension D10 may be between about 3 inches and about 20 inches, or about 9 inches and about 17 inches, or about 10 inches and about 15 inches, or about 13 inches and about 14 inches, or about 13.5 inches, or at least about 5 inches, or at least about 10 inches, or at least about 13 inches, or at least about 14 inches. As noted herein, dimensions D1, D2, D3, D4, D5, D6, D7, D8, D9, D10 are taken when the garment 100 is laying flat on a ground, surface, table, floor, etc. with the front 182 on top. Further, any of the above or below dimensions may be expressed as a ratio when compared with another dimension based on a conversion from inches.

Figure 4:
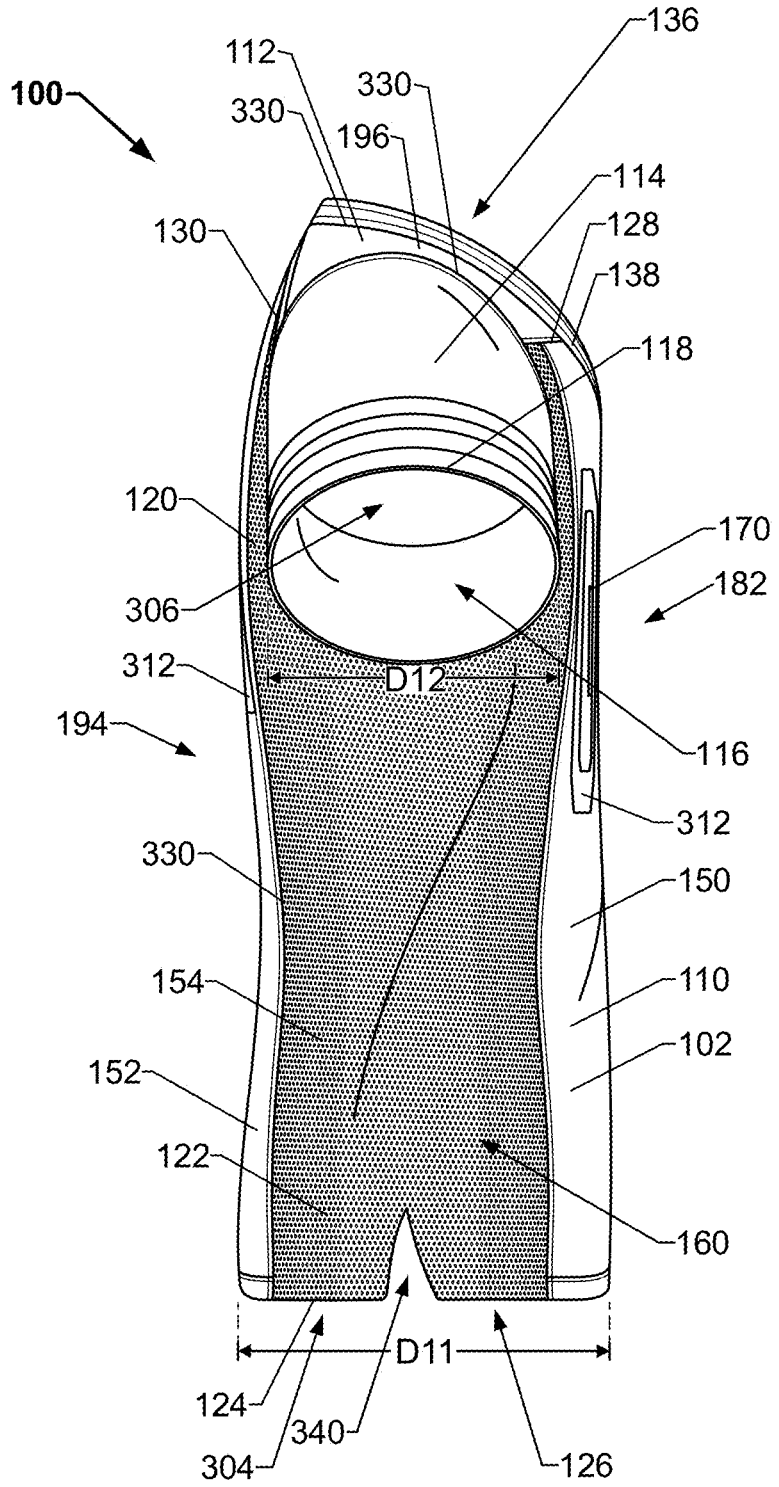
FIG. 4 is a side view of the garment of FIG. 1.

Referring to FIG. 4, a right side view of the garment 100 is shown. Each of the first half 102 and the second half 104 of the garment 100 include a cutout 340 formed in the first bottom end 124 and the second bottom end 220, respectively. In some embodiments, the first half 102 and/or the second half 104 may not include the cutout 340. The first half 102 and the second half 104 of the garment 100 may include a depth that defines a dimension D11, respectively. In some embodiments, the dimension D11 may be between about 5 inches and about 30 inches, or about 10 inches and about 25 inches, or about 15 inches and about 20 inches, or about 17 inches, or at least about 10 inches, or at least about 15 inches, or at least about 17 inches. As illustrated in FIG. 4, the first and second armholes 116, 208 may include a dimension D12, respectively. In some embodiments, the dimension D12 may be between about 5 inches and about 25 inches, or about 10 inches and about 20 inches, or about 12 inches and about 16 inches, or about 14 inches, or at least about 5 inches, or at least about 10 inches, or at least about 14 inches. As noted herein, dimensions D11, D12 are taken when the garment 100 is laying flat on the ground, table, floor, etc. and on its side facing up. As further illustrated in FIGS. 1-4, the first and second arm sleeves 114, 206 may include hemming at the first and second distal ends 118, 210 that form the first and second armholes 116, 208.

Although the garment 100 is depicted with various dimensions, it is contemplated that the garment 100 may comprise any dimension in order to allow two people or wearers to wear the garment at the exact same time.

Referring now to FIG. 5A, the garment 100 is illustrated in the unassembled state. Specifically, the first half 102 is separated from the second half 104 of the garment 100. In the unassembled state, the plurality of first buttons 176 are disconnected from the plurality of second buttons 180 and the first zipper assembly 186 is disconnected from the second zipper assembly 260. Further, in the unassembled state, the garment 100 may be stored or moved more easily than when in the assembled state. As illustrated in FIG. 5B, the plurality of first and second buttons 176, 180 and the first and second zipper assemblies 186, 260 are shown in greater detail. In some embodiments, the rear 194 of the garment 100 may include snap-on buttons similar to the front 182 of the garment 100 instead of the zipper assemblies 186, 260. Further, in some embodiments, the front 182 of the garment 100 may include zipper assemblies 186, 260 similar to the rear 194 of the garment 100 instead of having the snap-on buttons. Furthermore, in some embodiments, the two halves 102, 104 of the garment 100 may be secured together (in the front 182 and/or in the rear 194) by VELCRO®, flat buttons, magnets, and/or hook and latch features. As noted herein, the plurality of first and second buttons 176, 180 are configured to break apart easily. Thus, if one of the wearers trips and falls forward, the plurality of buttons 176, 180 are designed to break apart to allow the wearer to break through and not cause the other wearer to fall down. In some embodiments, the two halves 102, 104 may be secured to each other in the front 182 and/or in the rear 194 by a plurality of magnets, ferromagnetic material, and/or magnetic elements instead of the plurality of first and second buttons 176, 180 and/or the first and second zipper assemblies 186, 260. In such embodiments, various magnets or ferromagnetic material would be positioned along the first front edge 178, the first rear edge 188, the second front edge 256, and/or the second rear edge 262 similar to how the plurality of first and second buttons 176, 180 are positioned on the garment 100. In some embodiments, the magnets or ferromagnetic material would be positioned within a fabric of the garment 100, i.e., in a fabric pocket or cavity within the fabric of the garment 100, and allow the areas adjacent the first front edge 178, first rear edge 188, the second front edge 256, and/or the second rear edge 262 to secure to each corresponding edge.

Referring to FIGS. 1-5B, a method of using the garment 100 will be described below. Specifically, if the garment 100 is in the unassembled state, the two halves 102, 104 are placed next to each other and the user or wearer zips up the two zipper assemblies 186, 260 on the rear 194 of the garment 100. Once the rear 194 of the garment 100 is closed and secured together, the garment 100 can be placed on the two wearers. Once the garment 100 is placed on the two wearers, the plurality of first and second buttons 176, 180 can be secured together to secure the front 182 of the garment 100. Once the plurality of first and second buttons 176, 180 are secured to each other, the garment 100 is in the assembled state on the wearers. The steps for removing the garment 100 are the same as the above except in reverse order. Further, in some embodiments, the front 182 and rear 194 of the first and second halves 102, 104 of the garment 100 can be secured together before the garment 100 is placed onto the wearers. Instead, once the garment 100 is in the assembled state, the garment 100 can be put over the wearers by placing the garment 100 over the heads of the wearers. During use, the wearers can partake in different activities together. Furthermore, in some embodiments, the front 182 of the garment 100 can be secured together first, then the wearers can put on the garment 100, and then the rear 194 of the garment 100 can be secured together.

Referring again to FIG. 1, once the wearers are wearing the garment 100, a first wearer or person 402 can be positioned within the internal cavity 306 of the garment 100 and primarily within the first half 102 (on the right side) of the garment 100. The garment 100 is configured for the first person 402 to have his or her right arm extending through the first arm sleeve 114. During use, the first person's 402 left arm can either be positioned inside of the internal cavity 306 of the garment 100 or be placed through the first arm slit 170. As illustrated in FIG. 1, the second wearer or person 404 can be positioned within the internal cavity 306 of the garment 100 and primarily within the second half 104 (on the left side) of the garment 100. The garment 100 is configured for the second person 404 to have his or her left arm extending through the second arm sleeve 206. During use, the second person's 404 right arm can either be positioned inside of the internal cavity 306 of the garment 100 or be placed through the second arm slit 250. Thus, as discussed above, the first arm slit 170 and the second arm slit 250 are configured to allow the first or second persons 402, 404 to have their arms near a center of the garment 100 extend out of the internal cavity 306 of the garment 100 to better allow them to partake in activities or hold items.

Figure 6:
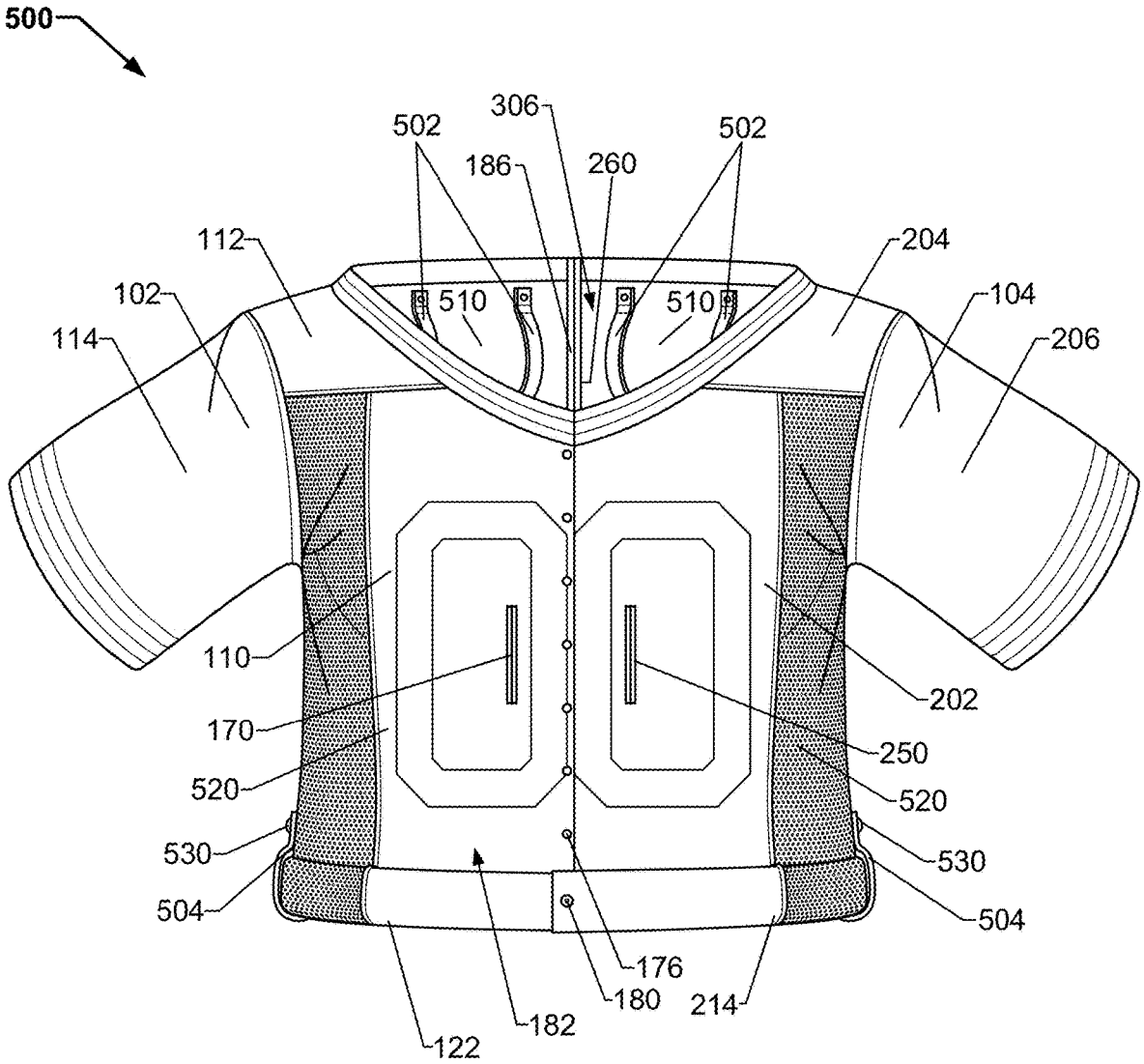
FIG. 6 is a front view of another embodiment of an article of apparel configured as a garment.

Referring to FIG. 6, like reference numbers are used with regard to an alternative embodiment of an article of apparel configured as a garment or sports garment 500. As noted herein, the garment 100 of FIGS. 1-5B is similar to the garment 500 of FIG. 6 except for a plurality of shoulder straps 502 and a plurality of lower straps 504. As illustrated in FIG. 6, the plurality of shoulder straps 502 are positioned within the interior cavity 306 of the garment 500. The plurality of shoulder straps 502 are secured to an interior surface 510 of the first and second halves 102, 104 of the garment 500. Specifically, the plurality of shoulder straps 502 are secured to the first and second body portions 110, 202 on the interior surface 510 opposite the rear 194 of the garment 500. The plurality of shoulder straps 502 are adjustable and extend from an area adjacent the garment neck opening 302 to an area below the first and second yoke portions 112, 204. In some embodiments, the garment 500 may include four shoulder straps 502, i.e., two shoulder straps 502 on the first half 102 and two shoulder straps 502 on the second half 104 of the garment 500. Thus, in some embodiments, there may be two shoulder straps 502 for each wearer of the garment 500. Further, in some embodiments, the garment 500 may only include two shoulder straps 502, i.e., one shoulder strap 502 on each half 102, 104 of the garment 500 or two shoulder straps 502 on one of the halves 102, 104 and no shoulder straps 502 on the other half 102, 104 of the garment 500. Furthermore, in some embodiments, the garment 500 may include 1, 2, 3, 4, 5, 6, 7, 8, 9, or more shoulder straps 502.

Referring still to FIG. 6, the plurality of shoulder straps 502 are configured to be worn by one or more of the wearers. Thus, one or more of the wearers of the garment 500 may put an arm through each of the shoulder straps 502 on their respective side of the garment 500. The plurality of shoulder straps 502 can then rest on the wearers shoulders during use to help keep the garment 500 up and on the wearer. In some embodiments, the plurality of shoulder straps 502 can be used by one of the wearers when one of the wearers is taller than the other wearer of the garment 500. Thus, by having the taller wearer wear one or two of the plurality of shoulder straps 502, the garment 500 can be positioned better and limit the garment 500 from falling down or becoming uneven. In some embodiments, the garment 500 may not include any shoulder straps 502. In some embodiments, the plurality of shoulder straps 502 can be removably attached to the interior surface 510 of the garment 500. Thus, in some embodiments, the wearers can remove the plurality of shoulder straps 502 if they do not want to use them.

Referring still to FIG. 6, the plurality of lower straps 504 are positioned on the first lower body portion 122 and the second lower body portion 214 of the first body portion 110 and the second body portion 202, respectively. As illustrated in FIG. 6, the garment 500 includes two lower straps 504 with one of the lower straps 504 on the first half 102 and one of the lower straps 504 on the second half 104 of the garment 500. The plurality of lower straps 504 are positioned on a side of the first and second halves 102, 104. Specifically, the plurality of lower straps 504 are positioned on the first mesh portion 154 and the second mesh portion 244 of the first body portion 110 and the second body portion 202. However, it is contemplated that the plurality of lower straps 504 may be positioned on any portion of the first and second lower body portions 122, 214 of the garment 500. In some embodiments, the garment 500 may include more than two lower straps 504. For example, in some embodiments, the garment 500 may also include lower straps 504 on the front 182 and/or the rear 194 of the garment 500. Further, in some embodiments, the garment 500 may include 1, 2, 3, 4, 5, 6, 7, 8, or more lower straps 504. Furthermore, in some embodiments, the garment 500 may not include any lower straps 504.

Referring still to FIG. 6, the plurality of lower straps 504 are adjustable and are configured to allow the garment 500 to be rolled up to a knee height for increased mobility of the wearers. In other words, the first bottom end 124 and the second bottom end 220 of the first and second halves 102, 104 of the garment 500 can be rolled or folded up to a knee height of the wearers to allow the wearers to have better mobility while wearing the garment 500. As illustrated in FIG. 6, one side of the lower strap 504 can be secured to the interior surface 510 of the garment 500 and the other side can be secured to an exterior surface 520 of the garment 500. In some embodiments, the garment 500 may include clips, snap buttons, fasteners, buckles, and/or latches fixed to the first and second halves 102, 104 of the garment 500 (on the interior surface 510 and the exterior surface 520) that secure with the plurality of lower straps 504. Thus, in some embodiments, the plurality of lower straps 504 may be removably attached to the garment 500. Furthermore, in some embodiments, the plurality of lower straps 504 may be permanently fixed to the interior surface 510 of the garment 500 at one end and have a free end opposite the end fixed to the interior surface 510 that can be removably attached to the securing feature, e.g., clip, snap button, fastener, buckle, and/or latch, positioned on the exterior surface 520 of the garment 500. Therefore, when not in use, the plurality of lower straps 504 may hang down within the interior cavity 306 of the garment 500. As noted herein, the plurality of shoulder straps 502 and the plurality of lower straps 504 are adjustable so that the length of the plurality of shoulder straps 502 and the plurality of lower straps 504 can be adjusted. In some embodiments, the garment 500 may include VELCRO® or another similar securement feature on a portion of the interior surface 510 and on a portion of the exterior surface 520 of the garment 500 that mate together to secure the first and second bottom ends 124, 220 in a folded up or rolled up configuration.

As noted here, in some embodiments, the garment 500 may include the plurality of shoulder straps 502 but not include the plurality of lower straps 504 and vice versa. The plurality of shoulder straps 502 and the plurality of lower straps 504 help to offer additional functionality of the garment 500 and increase the comfort of the garment 500 for the wearers. As illustrated in FIG. 6, the garment 500 includes button snaps 530 for the plurality of lower straps 504. However, in some embodiments, the garment 500 may include clips, fasteners, buckles, or latches for securing the plurality of lower straps 504 to the garment 500.

Figure 7:
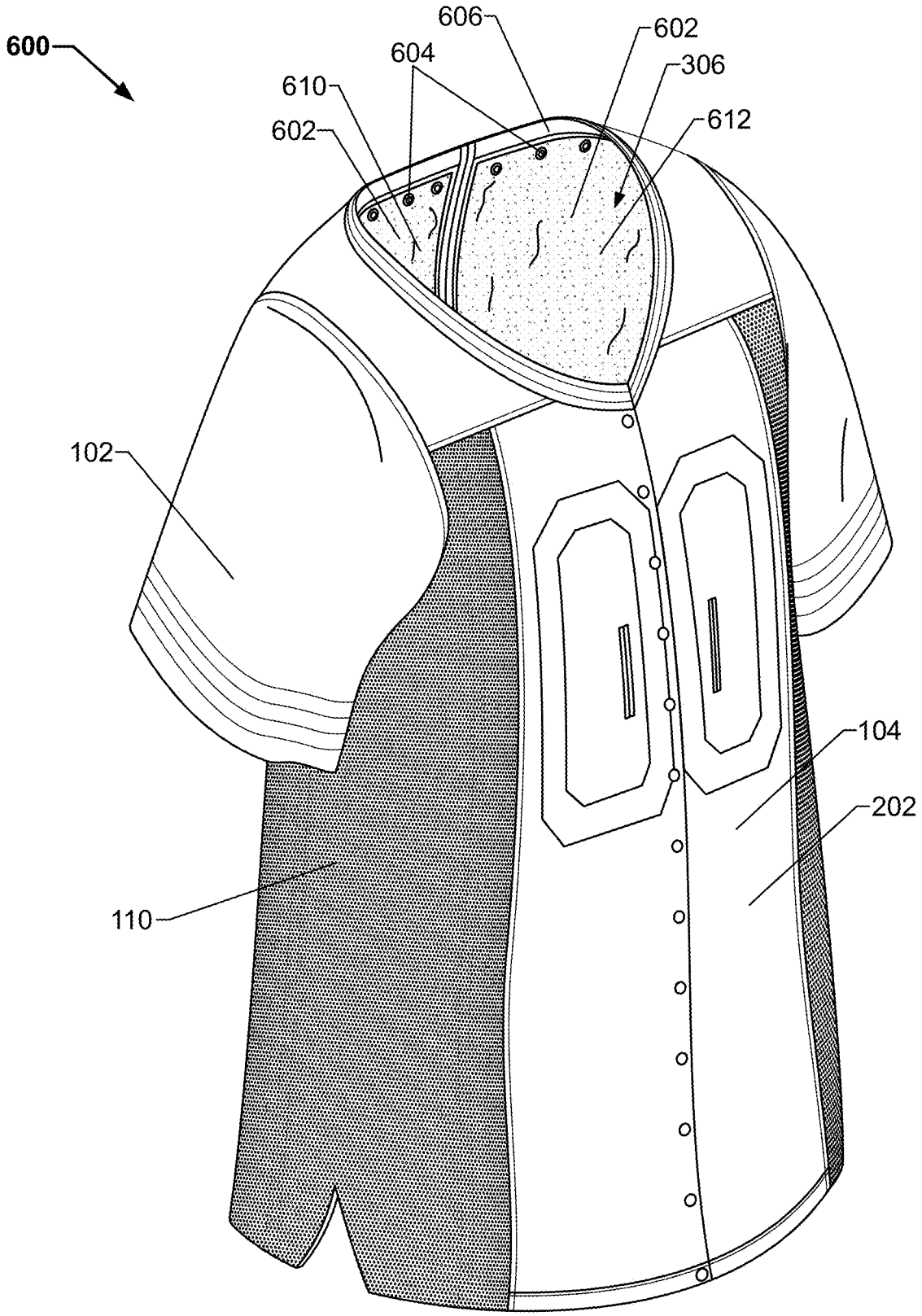
FIG. 7 is a front and side perspective view of yet another embodiment of an article of apparel configured as a garment.

Referring to FIG. 7, like reference numbers are used with regard to an alternative embodiment of an article of apparel configured as a garment or sports garment 600. As noted herein, the garment 100 of FIGS. 1-5B is similar to the garment 600 of FIG. 7 except for an inner liner 602 positioned within the interior cavity 306 of the garment 600. The inner liner 602 may be a cold weather liner and can help better insulate the garment 600 and the wearers. The inner liner 602 may be used for cold weather activities or when the weather is cold outside. The inner liner 602 can be removably attached to the garment 600. Specifically, the inner liner 602 can include a plurality of liner buttons 604 that mate with a plurality of buttons (not shown) on an interior surface 606 of the garment 600. Thus, through snap on buttons, the inner liner 602 can be removably attached to the interior surface 606 of the garment 600. As illustrated in FIG. 7, the inner liner 602 includes a first inner liner 610 and a second inner liner 612. The first inner liner 610 is secured with the first half 102 of the garment 600 and the second inner liner 612 is secured with the second half 104 of the garment 600. Thus, the inner liner 602 can be split in two once a wearer converts the garment 600 into the unassembled state. In some embodiments, the inner liner 602 may be a single piece and not broken up into two pieces. Furthermore, in some embodiments, the inner liner 602 may be permanently affixed to the interior surface 606 of the garment 600 and may not be removeable. In some embodiments, the inner liner 602 may be formed from wool, cotton, fleece, polyester, nylon, THINSULATE™ (synthetic thermal insulation), or cotton twill.

Figure 8:
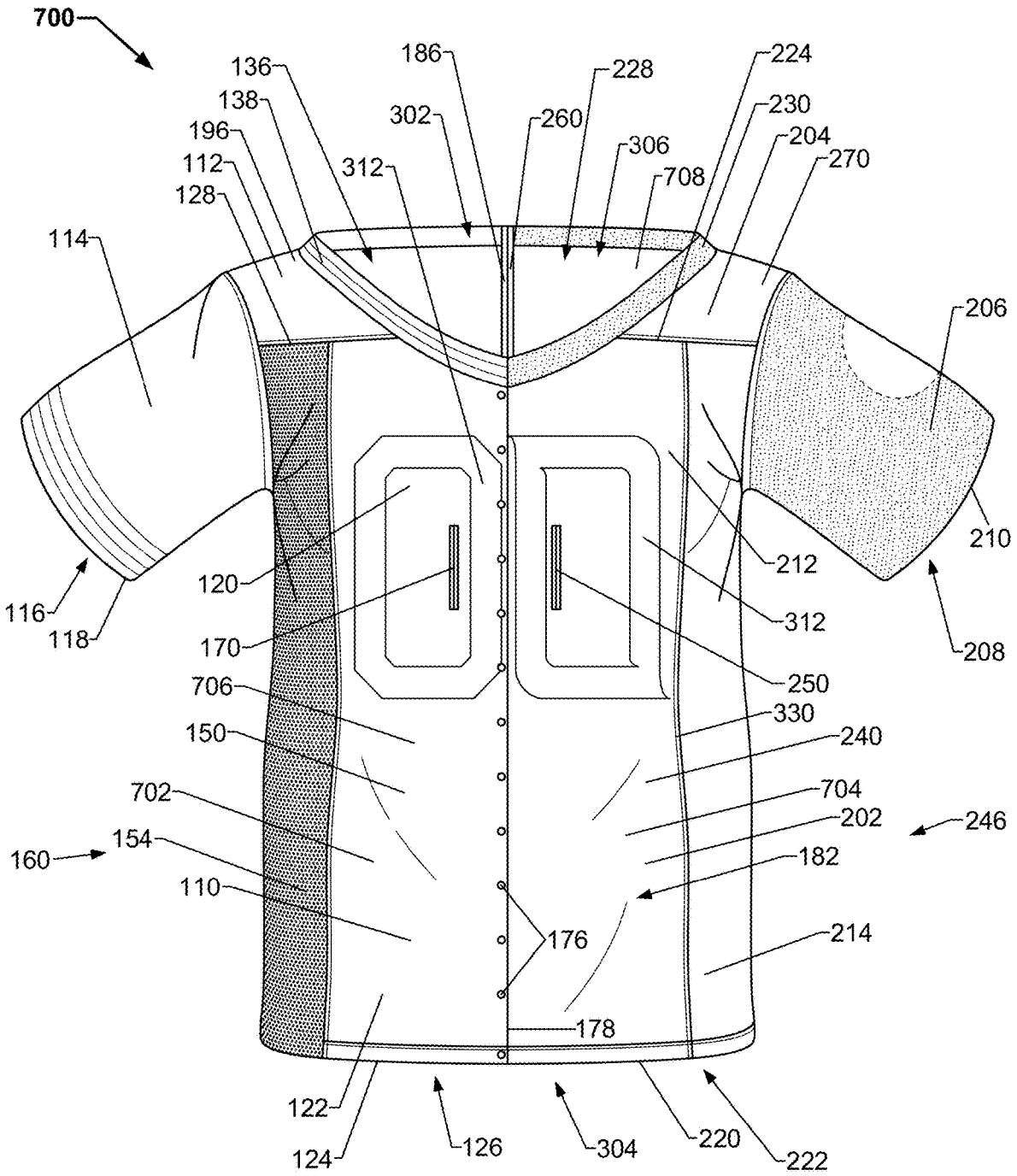
FIG. 8 is a front view of still another embodiment of an article of apparel configured as a garment.

Referring to FIG. 8, like reference numbers are used with regard to an alternative embodiment of an article of apparel configured as a garment or sports garment 700. As noted herein, the garment 100 of FIGS. 1-5B is similar to the garment 700 of FIG. 8 except for the features outlined below. As illustrated in FIG. 8, the garment 700 includes a first portion or half 702 and a second portion or half 704. As noted herein, the first half 702 of FIG. 8 can be identical to the first half 102 of FIGS. 1-5B and outlined above. The second half 704 of FIG. 8 can be identical to the second half 104 of FIGS. 1-5B; however, the second half 704 may include different colors, logos, and/or texture. In other words, the second half 704 may represent a half of a jersey that is different than the half of the jersey represented by the first half 702. Thus, the first half 702 may represent a jersey for a first team and the second half 704 may represent a jersey for a second team that is different than the first team.

Thus, the garment 700 may represent two sports teams at once, i.e., the first half 702 represents one team and the second half 704 represents a different team. As noted herein, the features and elements of the garment 700 are identical to the garment 100 of FIGS. 1-5B except for the logos, graphics, iconography, texts, and/or designs of one half 702, 704 are different than the other half 702, 704. As such, if the wearers of the garment 700 root for two separate teams, one of the wearers of the garment 700 can have their team on the first half 702 and the other wearer of the garment 700 can have their team on the second half 704 or vice versa. Therefore, the garment 700 can be customizable to include any combination of halves 702, 704 with different teams or styles thereon. In some embodiments, the texture and designs of each half 702 of the garment 700 may be different depending on the team associated with the half 702, 704. For example, a team or style of one of the halves 702, 704 may not include the first or second mesh portions 154, 244 (see FIG. 8). Thus, the garment 700 can be customizable depending on the two halves brought together.

In some embodiments, the garment 700 may come with, i.e., may be purchased, with the first half 702 being different than the second half 704 with respect to the team of the jersey. Further, in some embodiments, the garment 700 may come with, i.e., may be purchased, with the first half 702 being the same as the second half 704 with respect to the team of the jersey. Thus, the wearers can purchase different team jersey sets and then mix and match them depending on the style or desire of the wearers. Therefore, it is noted herein that the first half 702 of one team jersey is compatible with the second half 704 of a different team jersey. In some embodiments, the garment 700 may be sold as a kit that includes the first half 702 and the second half 704. The kit may represent a specific sports team or be a jersey of a specific player. As wearers collect more kits, the wearers can mix and match the first half 702 in one kit with the second half 704 in another kit or vice versa. In some embodiments, the kit may only include one of the first half 702 or the second half 704 of the garment 700. Thus, the wearer would need to purchase a separate kit to fill out and form the garment 700. In some embodiments, the first half 702 and the second half 704 may be reversable. Thus, the same features and iconography on an exterior surface 706 of the first half 702 or the second half 704 will be the same on an interior surface 708 of the first half 702 or the second half 704. Therefore, the first half 702 can be converted into the second half 704 by folding the first half 702 inside out. As such, a kit may sell a single half 702, 704 of the garment 700 that can serve as either the first half 702 or the second half 704 depending on the wearer. Then, the wearer need only purchase two kits so that they can form the garment 700. Furthermore, in some embodiments, the kit may include the first half 702 and the second half 704 and both halves 702, 704 can be reversible such that the first half 702 can become the second half 704 and the second half 704 can become the first half 702 such that wearers can mix and match the desired half 702, 704 with a different half 702, 704 from a different kit. Still further, in some embodiments, the first half 702 and/or the second half 704 may be reversible and have different iconography or be directed at a different team on the reversible side.

As noted herein, the garments 100, 500, 600, 700 are designed to be worn by and to fit two people at the same exact time. In other words, the garments 100, 500, 600, 700 allow for two people to don the same jersey in a side-by-side fashion at the same time. Thus, the two halves 102, 104, 702, 704 of the garments 100, 500, 600, 700 can be combined together to make one large garment 100, 500, 600, 700. The garment 100, 500, 600, 700 can be used in the home, at social gatherings, and at sporting events. When worn, the two wearers would stand or sit side-by-side to provide a comedic visual, sporting fun, and/or to benefit from shared warmth in cold environments.

Any of the embodiments described herein may be modified to include any of the structures or methodologies disclosed in connection with different embodiments. Similarly, materials or construction techniques other than those disclosed above may be substituted or added in some embodiments according to known approaches. Further, the present disclosure is not limited to articles of apparel of the type specifically shown. Still further, aspects of the articles of apparel of any of the embodiments disclosed herein may be modified to work with any type of apparel or athletic apparel.

As noted previously, it will be appreciated by those skilled in the art that while the disclosure has been described above in connection with particular embodiments, processes, and examples, the disclosure is not necessarily so limited, and that numerous other embodiments, processes, examples, uses, modifications and departures from the embodiments, processes, examples and uses are intended to be encompassed by the claims attached hereto.

What is claimed is:

1. A two-person sports garment, comprising:

a first half including a first front edge;

a second half including a second front edge; and a garment neck opening formed by the first half and the second half, the garment neck opening defining a width (D1) of between about 20 inches and 30 inches when the two-person sports garment is lying flat on a surface, and the garment neck opening defining a height (D5) of between about 8 inches and 10 inches when the two-person sports garment is lying flat on the surface, wherein the first half includes a first bottom end and the second half includes a second bottom end, wherein the first half and the second half are removably secured to each other in a front of the two-person sports garment by a plurality of buttons, and the first half and the second half are removably secured to each other in a rear of the two-person sports garment by a zipper, wherein the first half includes a first arm sleeve that forms a first armhole and the second half includes a second arm sleeve that forms a second armhole, wherein the first half includes a first arm slit and the second half includes a second arm slit, wherein a dimension (D6) from the first and second bottom ends to a bottommost part of the first and second arm slits, respectively, is between about 10 inches and 60 inches when the two-person sports garment is lying flat on the surface, wherein the first arm slit and the second arm slit each have a height (D8) of between about 4 inches and 8 inches when the two-person sports garment is lying flat on the surface, wherein a dimension (D7) from the first front edge and the second front edge to the first arm slit and the second arm slit, respectively, is between about 3 inches and 7 inches when the two-person sports garment is lying flat on the surface, wherein the first and second armholes have a dimension (D10) of between about 10 inches and 15 inches when the two-person sports garment is lying flat on the surface, wherein the first arm sleeve defines a first distal end and the second arm sleeve defines a second distal end, and wherein the first and second arm sleeves have a dimension (D9) from the garment neck opening to the first and second distal ends, respectively, of between about 25 inches and 32 inches when the two-person sports garment is lying flat on the surface, wherein a dimension (D4) from the first and second bottom ends to a bottom section of the first and second arm sleeves, respectively, is between about 20 inches and 50 inches when the two-person sports garment is lying flat on the surface, and wherein the two-person sports garment is configured to be worn by two people at the same time.

2. The two-person sports garment of claim 1, wherein the first arm slit and the second arm slit are positioned closer to the plurality of buttons than the first armhole and the second armhole, respectively.

3. The two-person sports garment of claim 1, wherein the two-person sports garment is configured to have a first arm of a first person extend through the first armhole and a second arm of the first person extend through the first arm slit, and wherein the two-person sports garment is further configured to have a first arm of a second person extend through the second armhole and a second arm of the second person extend through the second arm slit.

4. The two-person sports garment of claim 1, wherein the two-person sports garment further comprises a removable inner liner.

5. The two-person sports garment of claim 1, wherein the first half and the second half each includes a plurality of text thereon.

6. The two-person sports garment of claim 1, wherein the first half represents a first sports team and the second half represents a second sports team different than the first sports team.

7. The two-person sports garment of claim 1, wherein the two-person sports garment includes a plurality of lower straps that are configured to hold up the first bottom of the first half and the second bottom end of the second half.

8. A sports garment, comprising:

a first half including a first arm sleeve that forms a first armhole, wherein the first half includes a first arm slit spaced from the first armhole, and wherein the first half includes a first front edge;

a second half removably attached to the first half, the second half including a second arm sleeve that forms a second armhole, and the second half including a second arm slit spaced from the second armhole, wherein the second half includes a second front edge; and a garment neck opening formed by the first half and the second half, the garment neck opening defining a width (D1) of between about 20 inches and 30 inches when the sports garment is lying flat on a surface, wherein the sports garment defines a height (D3) from a bottom end of the sports garment to a topmost portion of the sports garment of at least about 40 inches when the sports garment is lying flat on the surface, and wherein the garment neck opening defines a height (D5) of between about 8 inches and 10 inches when the sports garment is lying flat on the surface, wherein the first and second armholes each have a dimension (D10) when the sports garment is lying flat on the surface, wherein the first arm slit and the second arm slit each have a height (D8), and wherein the dimension (D10) of the first and second armholes is greater than the height (D8) of the first arm slit and the second arm slit, wherein a dimension (D7) from the first front edge and the second front edge to the first arm slit and the second arm slit, respectively is between about 3 inches and 7 inches when the sports garment is lying flat on the surface, wherein the first arm sleeve defines a first distal end and the second arm sleeve defines a second distal end, and wherein the first and second arm sleeves have a dimension (D9) from the garment neck opening to the first and second distal ends, respectively, of between about 25 inches and 32 inches when the sports garment is lying flat on the surface, and wherein the sports garment is configured to be worn by two people at the same time.

9. The sports garment of claim 8, wherein the width is between about 22 inches and 26 inches when the sports garment is lying flat on the surface.

10. The sports garment of claim 8, wherein the height is between about 58 inches and 62 inches when the sports garment is lying flat on the surface.

11. The sports garment of claim 8 further comprising a plurality of shoulder straps positioned within an interior cavity of the sports garment.

12. The sports garment of claim 8, wherein the first half includes a first zipper assembly and a plurality of first button portions, and wherein the second half includes a second zipper assembly and a plurality of second button portions.

13. The sports garment of claim 12, wherein the first zipper assembly is configured to be secured with the second zipper assembly by a zipper, and wherein the plurality of first portions buttons is configured to be secured with the plurality of second button portions.

14. The sports garment of claim 13, wherein the plurality of first button portions and the plurality of second button portions are snap on buttons that mate with each other.

15. The sports garment of claim 8, wherein the sports garment includes a name plate that is positioned partially on the first half and partially on the second half of the sports garment.

16. The sports garment of claim 8, wherein the first half represents a first sports team and the second half represents a second sports team different than the first sports team.

17. A garment, comprising:

a first half including a first arm sleeve that forms a first armhole, wherein the first half includes a first arm slit spaced from the first armhole, wherein the first half includes a first front edge;

a second half including a second arm sleeve that forms a second armhole, the second half being removably attached to the first half, and the second half including a second arm slit spaced from the second armhole, wherein the second half includes a second front edge; and a garment neck opening formed by the first half and the second half, the garment neck opening defining a width (D1) of between about 20 inches and 30 inches when the garment is lying flat on a surface, and the garment neck opening defining a height (D5) of between about 8 inches and 10 inches when the garment is lying flat on the surface, wherein the first half includes a first bottom end and the second half includes a second bottom end, wherein a dimension (D6) from the first and second bottom ends to a bottommost part of the first and second arm slits, respectively, is between about 10 inches and 60 inches when the garment is lying flat on the surface, wherein the first arm slit and the second arm slit each have a height (D8) of between about 4 inches and 8 inches when the garment is lying flat on the surface, wherein a dimension (D7) from the first front edge and the second front edge to the first arm slit and the second arm slit, respectively, is between about 3 inches and 7 inches when the garment is lying flat on the surface, wherein the first and second armholes have a dimension (D10) of between about 10 inches and 15 inches when the garment is lying flat on the surface, wherein the garment is configured to be worn by a first person and a second person at the same time, and wherein the garment is configured for the first person to put their first hand through the first armhole and their second hand through the first arm slit and is further configured for the second person to put their first hand through the second arm slit and their second hand through the second armhole.

18. The garment of claim 17, wherein the first half of the garment is a different color than the second half of the garment.

* * * * *